US008590628B2

(12) United States Patent
Allen et al.

(10) Patent No.: US 8,590,628 B2
(45) Date of Patent: Nov. 26, 2013

(54) SELECTIVE SLEEVE SYSTEM AND METHOD OF MOVING A SLEEVE

(75) Inventors: Jason A. Allen, Houston, TX (US); Steven Rowell Hayter, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 299 days.

(21) Appl. No.: 13/012,552

(22) Filed: Jan. 24, 2011

(65) Prior Publication Data

US 2012/0186824 A1 Jul. 26, 2012

(51) Int. Cl.
*E21B 23/00* (2006.01)

(52) U.S. Cl.
USPC ..... 166/381; 166/373; 166/332.1; 166/237

(58) Field of Classification Search
USPC ..... 166/373, 332.1, 381, 237
See application file for complete search history.

(56) References Cited

U.S. PATENT DOCUMENTS 4,577,685 A 3/1986 Eatwell
6,629,563 B2 10/2003 Doane
2005/0126787 A1 6/2005 Gomez
2006/0225878 A1 10/2006 Coronado
2008/0251259 A1* 10/2008 Braddick ..... 166/373
2009/0139726 A1 6/2009 Gomez

OTHER PUBLICATIONS

Notification of Transmittal of the International Search Report and the Written Opinion of the International Searching Authority; PCT/US2011/065831; mailed Jun. 29, 2012; Korean Intellectual Property Office; 9 pages.

Jesse J. Constantine, "Selective Production of Horizontal Openhole Completions Using ECP and Sliding Sleeve Technology"; Society of Petroleum Engineers, SPE Paper No. 55618; May 15, 1999.

Brian K. Drakeley et al., "Application of Reliability Analysis Techniques to Intelligent Wells"; Society of Petroleum Engineers, SPE Paper No. 83639; Apr. 30, 2001.

* cited by examiner

*Primary Examiner* — William P Neuder
*Assistant Examiner* — Taras P Bemko
(74) *Attorney, Agent, or Firm* — Cantor Colburn LLP

(57) ABSTRACT

A selective sleeve system includes, a tubular, a sleeve movably disposed at the tubular, and a movable member having at least one dog radially biased and configured to be radially displaceable into a recess. The at least one dog is positionable perimetrically adjacent to at least one tab, subsequent displacement into the recess to radially overlap with the sleeve sufficiently to move the sleeve relative to the tubular upon movement of the movable member relative to the tubular.

19 Claims, 6 Drawing Sheets

SELECTIVE SLEEVE SYSTEM AND METHOD OF MOVING A SLEEVE

BACKGROUND

Tubular systems often employ shifting mechanisms to release, actuate, or shift components positioned within the tubular. Such mechanisms often employ an exposed shoulder for latching to when shifting of the mechanism is desired. Although such shifting mechanisms perform as intended, the exposed shoulder can be inadvertently engaged with devices being run through the tubular causing actuation, release or shifting of the mechanism at undesirable times. Operators are, therefore, always interested in systems and methods that overcome the foregoing drawback.

BRIEF DESCRIPTION

Disclosed herein is a selective sleeve system. The system includes, a tubular, a sleeve movably disposed at the tubular, and a movable member having at least one dog radially biased and configured to be radially displaceable into a recess. The at least one dog is positionable perimetrically adjacent to at least one tab, subsequent displacement into the recess to radially overlap with the sleeve sufficiently to move the sleeve relative to the tubular upon movement of the movable member relative to the tubular.

Further disclosed herein is a method of moving a sleeve relative to a tubular. The method includes, running a movable member within a tubular, radially displacing at least one dog of the movable member into a radial recess perimetrically adjacent to at least one tab, contacting a sleeve with the at least one dog, and moving the sleeve with movement of the movable member

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
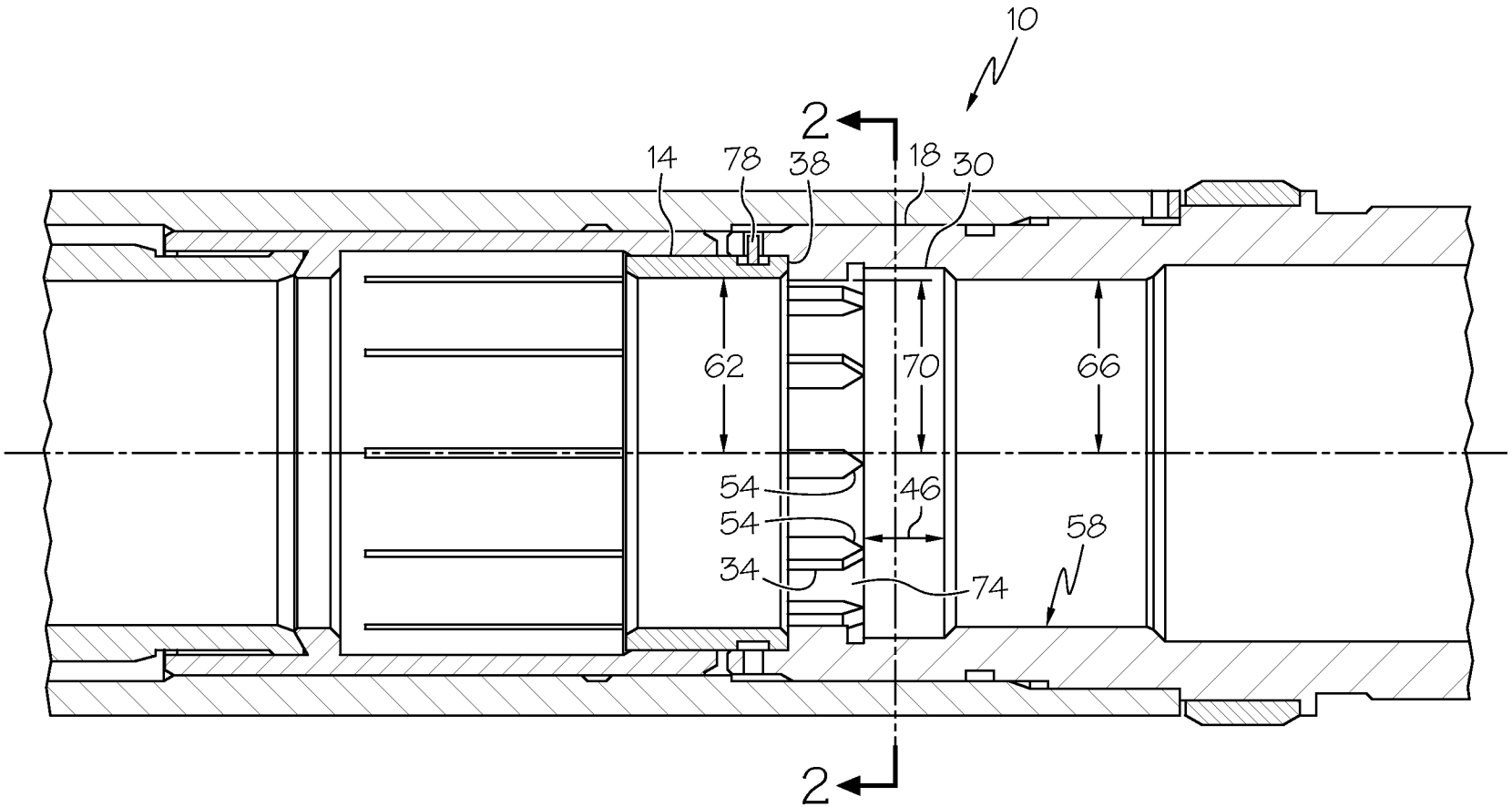
FIG. 1 depicts a cross sectional side view of a selective sleeve system disclosed herein.
Figure 3:
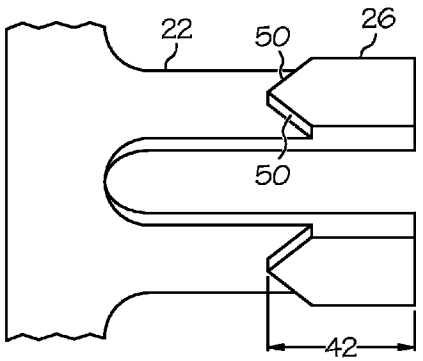
FIG. 3 depicts a partial view of a movable member of the selective sleeve system of FIG. 1.
Figure 2:
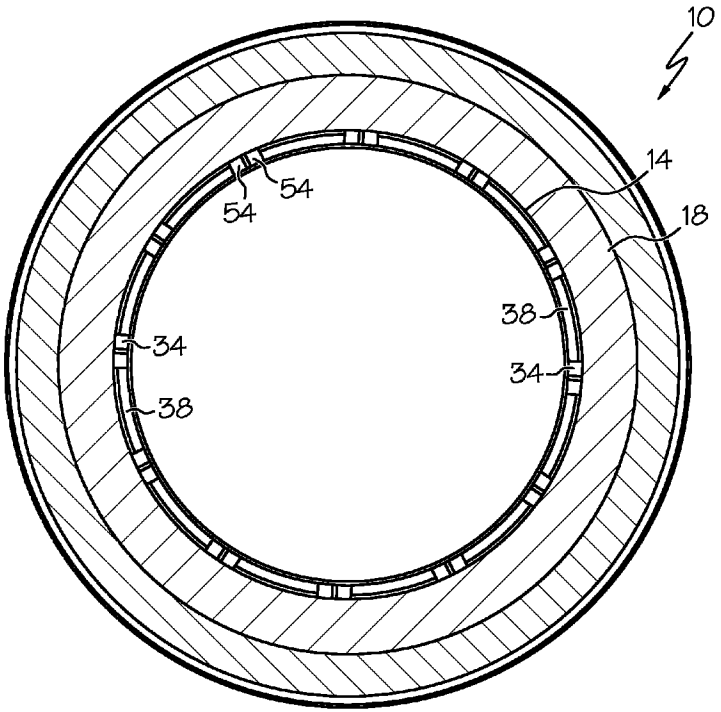
FIG. 2 depicts a cross sectional end view of the selective sleeve system of FIG. 1 taken at arrows 2-2.

Referring to FIGS. 1-3, an embodiment of a selective sleeve system disclosed herein is illustrated at 10. The system 10 includes, a sleeve 14 movably disposed at a tubular 18. A movable member 22, illustrated herein as a collet (shown in FIG. 3 but not in FIGS. 1 and 2 for clarity), that has at least one radially biased dog 26 (with a plurality of the dogs 26 being illustrated herein), is runnable within the tubular 18. The dogs 26 are radially movable (outwardly in this embodiment although reversal of the parts to allow the dogs 26 to displace radially inwardly is also contemplated), into an annular recess 30. The dogs 26 once positioned within the recess 30 are able to move longitudinally relative to at least one tab 34 (with a plurality of tabs 34 being illustrated herein), until the dogs 26 are perimetrically adjacent to the tabs 34. The dogs 26, once positioned perimetrically adjacent to the tabs 34 are able to move longitudinally in spaces 74 of the recess 30 until they contact a shoulder 38 of the sleeve 14. The dogs 26 while in the recess 30 radially overlap with the sleeve 14 such that continued longitudinal movement of the movable member 22 relative to the tubular 18 causes the sleeve 14 to also move relative to the tubular 18. This relative movement of the sleeve 14 to the tubular 18 can be employed to actuate a tool connected thereto in a number of ways including releasing a tool, such as a packer (not shown), for example.

A longitudinal dimension 42 of the dogs 26 is less than a longitudinal dimension 46 of a portion of the recess 30 longitudinally beyond the tabs 34 to assure that the dogs 26 will fit within the portion of the recess 30. Angled surfaces 50 on each of the dogs 26 are contactable with angled surfaces 54 on each of the tabs 34 to cause relative rotation between the movable member 22 and the tabs 34 in response to longitudinal movement of the movable member 22 relative to the tabs 34. Although the rotational movement could result from rotation of either the movable member 22 or the part that the tabs 34 are attached to (e.g. the tubular 18) it may be simpler to construct the system 10 when the movable member 22 is rotatable.

The system 10 is configured to prevent unintentional movement of the sleeve 14 relative to the tubular 18 by devices that may be run through the tubular 18 in either direction. As such, the recess 30 extends radially outwardly of a surface 58 of the tubular 18, while a minimum radial dimension 62 of the sleeve 14 is no smaller than either a minimum radial dimension 66 of the surface 58 or a minimum radial dimension of the tabs 70. As such, the minimum radial dimensions 66 and 70 tend to shield the sleeve 14 from devices that are run within the tubular 18. In fact, in order for a device run through the tubular 18 to catch on the sleeve 14 it would need to extend radially into the spaces 74 that are perimetrically between adjacent tabs 34. This condition is easily avoided with the system 10 by not running devices having protrusions that are sized perimetrically to fit between adjacent tabs 34.

One or more release member 78, with one being illustrated herein as a shear screw, longitudinally maintains the sleeve 14 relative to the tubular 18 until the release member 78 encounters a force exceeding a threshold force. The release member 78 provides additional assurance that the sleeve 14 will not be moved relative to the tubular 18 until the movable member 22 intentionally loads it. Although this embodiment employs a shear screw as the release member 78, alternate embodiments are contemplated, including, for example, frictional engagement between the sleeve 14 and the tubular 18 to avoid unintentional longitudinal movement of the sleeve 14.

As discussed above, the movable member 22 in the embodiment illustrated has a plurality of the dogs 26. Since each of the dogs 26 contacts the shoulder 38, this configuration provides an evenly distributed load to the sleeve 14 making cocking and wedging of the sleeve 14 unlikely. Furthermore, the plurality of dogs 26 and the plurality of tabs 34 as illustrated are distributed symmetrically about a perimeter. Although not a necessary condition, the symmetry simplifies the design and construction of the movable member 22 and the tabs 34. In applications such as the downhole hydrocarbon recovery industry, for example, where movement of the sleeve 14 can be employed to actuate a tool or release a tool, such as a packer, the forces needed to rotate the movable member 22 may be significant. As such, a design employing a plurality of the dogs 26 engaging with a plurality of the tabs 34 symmetrically, as discussed above, will distribute the load needed to rotate the movable member 22, thereby improving confidence in correct operation thereof.

Figure 4:
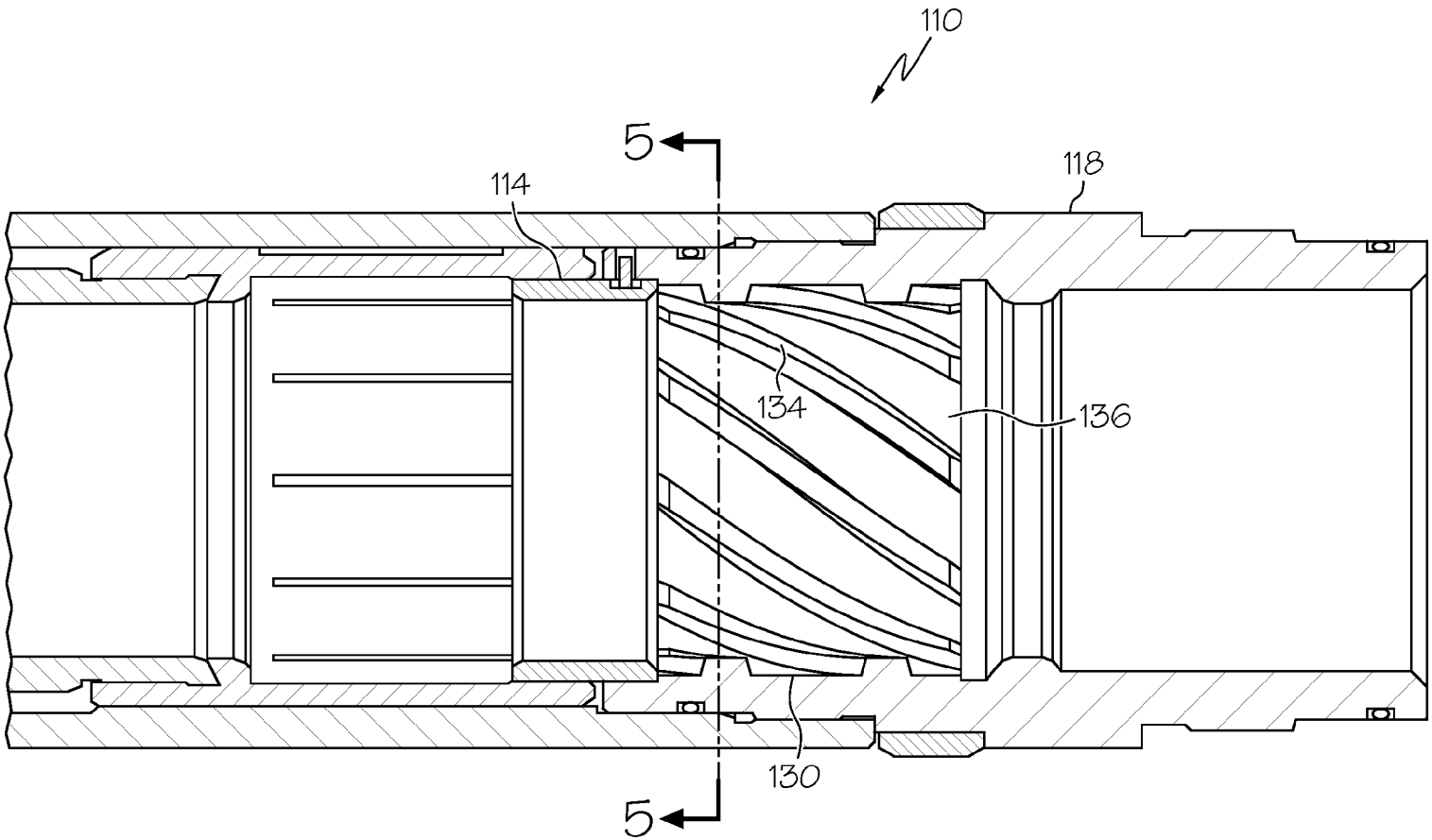
FIG. 4 depicts a cross sectional side view of an alternate embodiment of a selective sleeve system disclosed herein.
Figure 5:
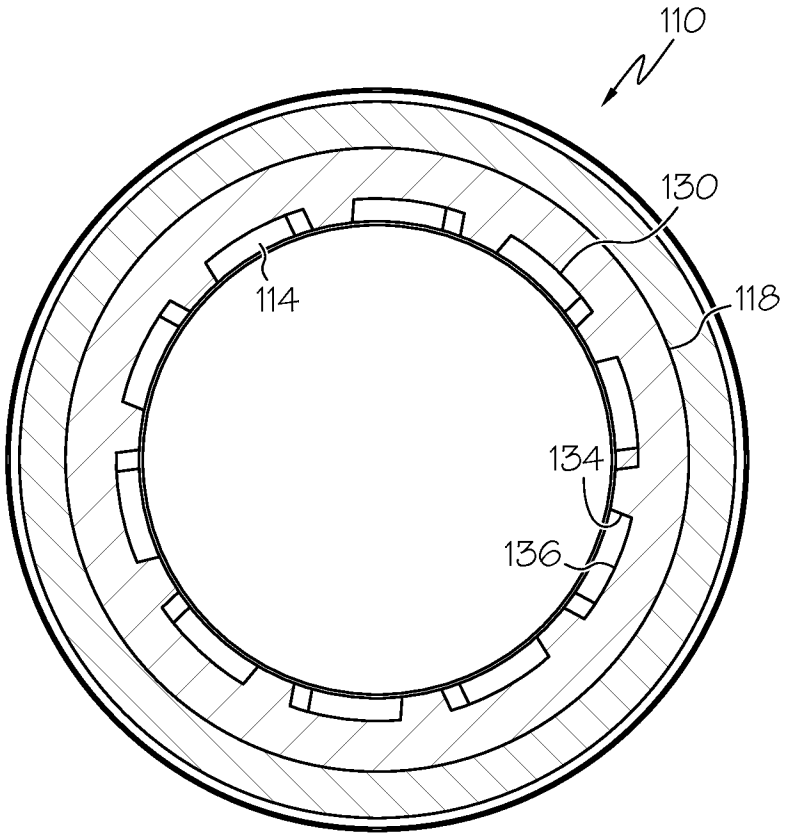
FIG. 5 depicts a cross sectional end view of the selective sleeve system of FIG. 5 taken at arrows 5-5.
Figure 6:
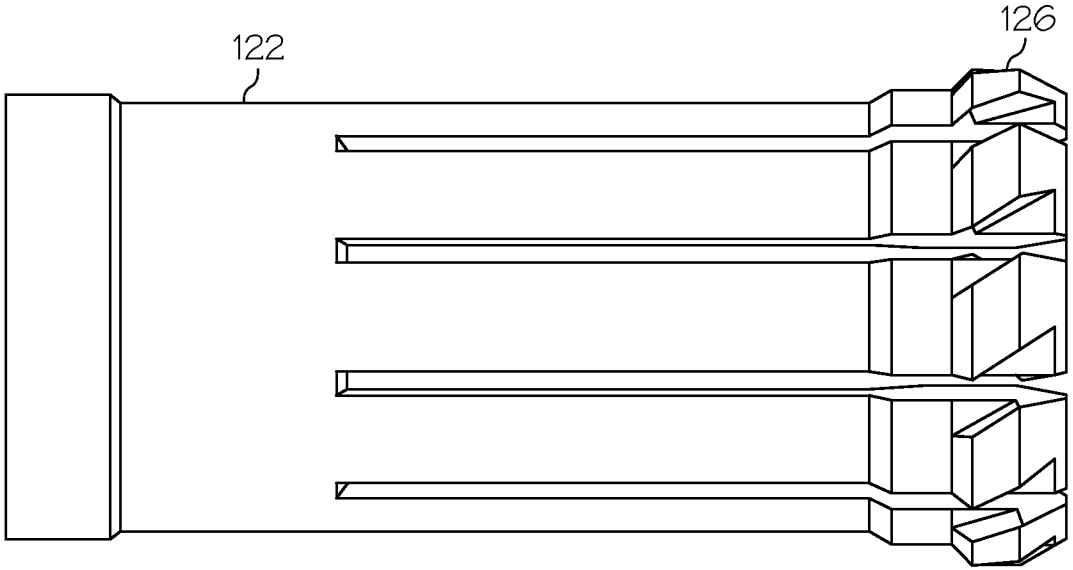
FIG. 6 depicts a side view of a movable member of the selective sleeve system of FIG. 4.
Figure 7:
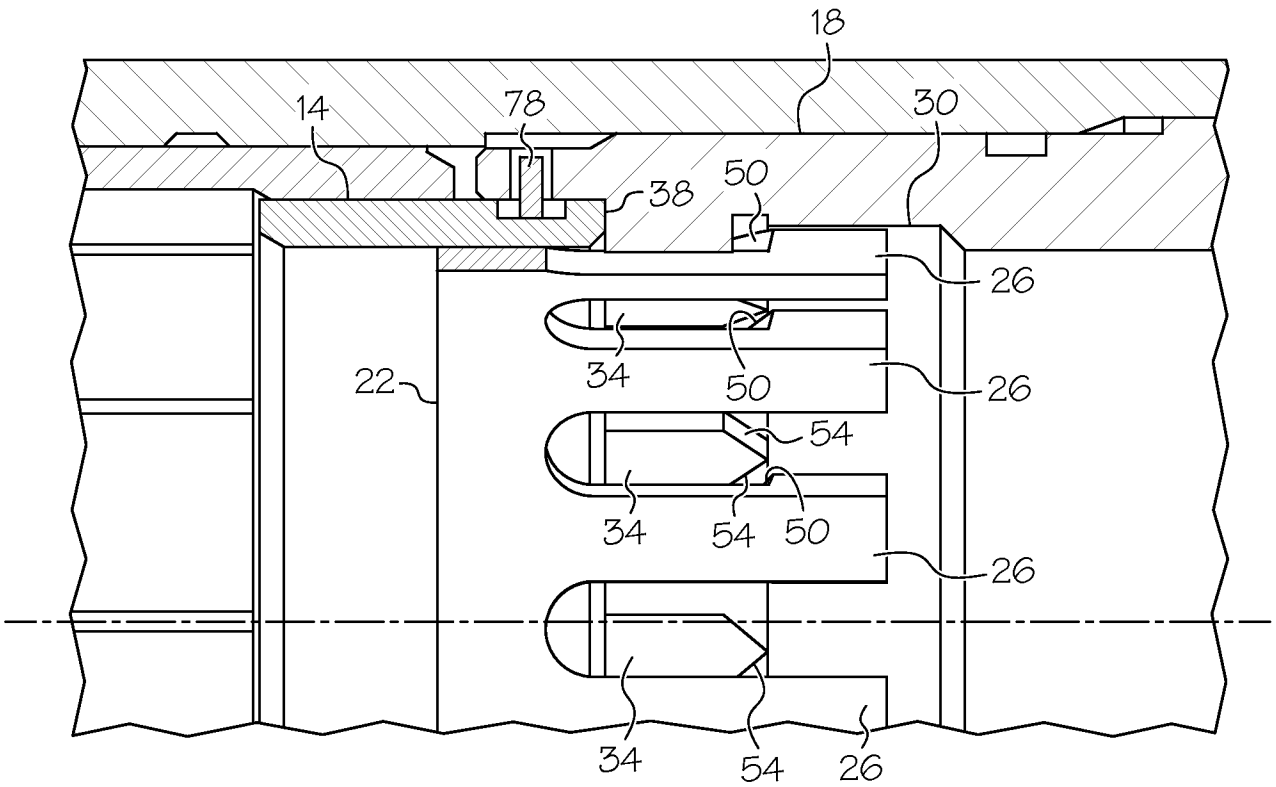
FIG. 7 depicts a partial cross sectional side view of the selective sleeve system of FIG. 1 with a portion of the movable member of FIG. 3 shown engaged therewith.

Referring to FIGS. 4-6, an alternate embodiment of a selective sleeve system disclosed herein is illustrated at 110. The primary difference between the system 110 and the system 10 is the configuration of dogs 126 (shown in FIG. 6 only) and tabs 134 and their fit with one another. The tabs 134 are positioned within a recess 130 of a tubular 118 and have a helical shape. The dogs 126 have a helical shape that is complementary to that of the tabs 134 and are biased radially outwardly on a movable member 122. As such, when the movable member 122 is moved longitudinally relative to the tubular 118 at some point the dogs 126 will become aligned with troughs 136 of the recess 130 defined between adjacent tabs 134 and the dogs 126 will move radially outwardly and engage with the tabs 134. Continued longitudinal movement of the movable member 122 will cause the movable member 122 to rotate relative to the tubular 118 as the dogs 126 travel along the helical path defined by the troughs 136. As with the system 10, the dogs 126, of the system 110 radially overlap with a sleeve 114 to assure that the dogs 126 cause the sleeve 114 to move as the movable member 122 continues its longitudinal movement.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A selective sleeve system comprising:

a tubular;

a sleeve movably disposed at the tubular; and a movable member having at least one dog radially biased and configured to be radially displaceable into a recess, the at least one dog being positionable to fit perimetrically between sides of at least one tab, subsequent displacement into the recess to radially overlap with the sleeve sufficiently to move the sleeve relative to the tubular upon movement of the movable member relative to the tubular.

2. The selective sleeve system of claim 1, wherein the recess extends radially outwardly of a surface of the tubular.

3. The selective sleeve system of claim 2, wherein minimum radial dimensions of the at least one tab are no smaller than minimum radial dimensions of the surface of the tubular.

4. The selective sleeve system of claim 1, wherein the at least one dog is a plurality of dogs that are configured to perimetrically fit between a plurality of the at least one tab.

5. The selective sleeve system of claim 4, wherein the plurality of the at least one tab are distributed perimetrically symmetrically.

6. The selective sleeve system of claim 4, wherein the plurality of the at least one dog are distributed perimetrically symmetrically.

7. The selective sleeve system of claim 1, wherein the at least one tab has a helical shape.

8. The selective sleeve system of claim 1, wherein the at least one tab is part of the tubular.

9. The selective sleeve system of claim 1, wherein the recess is in the tubular.

10. The selective sleeve system of claim 1, wherein at least one of the at least one tab and the at least one dog have angled surfaces that cause rotation between the movable member and the at least one tab to perimetrically adjacently align the at least one dog with the at least one tab.

11. The selective sleeve system of claim 1, wherein the movable member is rotationally movable relative to the tubular.

12. The selective sleeve system of claim 1, wherein the at least one dog is biased radially outwardly.

13. The selective sleeve system of claim 1, wherein maximum radial dimensions of the at least one tab are no larger than minimum radial dimensions of the sleeve.

14. The selective sleeve system of claim 1, wherein the movable member is a collet.

15. A method of moving a sleeve relative to a tubular comprising:

running a movable member within a tubular;

radially displacing at least one dog of the movable member into a radial recess defined between parametrical sides of at least one tab;

contacting a sleeve with the at least one dog; and moving the sleeve with movement of the movable member.

16. The method of moving a sleeve relative to a tubular of claim 15, wherein the radially displacing at least one dog displaces the at least one dog radially outwardly.

17. The method of moving a sleeve relative to a tubular of claim 15, further comprising positioning the at least one dog to a position perimetrically adjacent to the at least one tab.

18. The method of moving a sleeve relative to a tubular of claim 15, further comprising rotating the movable member.

19. The method of moving a sleeve relative to a tubular of claim 15, further comprising biasing the at least one dog radially.

* * * * *